United States Patent [19]

Newman et al.

[11] Patent Number: 4,896,168

[45] Date of Patent: Jan. 23, 1990

[54] LIGHT EMITTING DIODE PRINTHEAD

[75] Inventors: David A. Newman; William B. Scott, Jr.; Thomas E. Przybylowicz; Bryan A. Beaman; Wesley H. Bacon, all of Rochester, N.Y.

[73] Assignee: Eastman Kodak Company, Rochester, N.Y.

[21] Appl. No.: 238,646

[22] Filed: Aug. 30, 1988

[51] Int. Cl.[4] ..... G01D 9/42; H01L 23/02

[52] U.S. Cl. ..... 346/107 R; 357/81; 313/500

[58] Field of Search ..... 346/107 R, 139 R, 160, 346/108; 357/81, 17, 45; 358/302; 372/43; 313/500

[56] References Cited

U.S. PATENT DOCUMENTS

| | | | |
|---|---|---|---|
| 4,424,524 | 1/1984 | Daniele | 346/107 R |
| 4,506,272 | 3/1985 | Arai | 346/76 PH |
| 4,780,731 | 10/1988 | Creutzmann | 346/107 R |

*Primary Examiner*—Teresa J. Walberg
*Assistant Examiner*—Scott A. Rogers
*Attorney, Agent, or Firm*—Armin B. Pagel

[57] ABSTRACT

An LED array printhead comprises an elongate support bar of generally rectangular cross section with a row of LED array chips mounted end-to-end along one of the narrow elongate edge faces of the bar. The bar is sandwiched between heat sink members confronting its wide faces. The heat sink members dissipate heat from the bar and also support circuit board means electrically connected to the LED chips.

7 Claims, 4 Drawing Sheets

LIGHT EMITTING DIODE PRINTHEAD

BACKGROUND OF THE INVENTION

1. Field of the Invention

The present invention relates to printheads of the type employing a row of uniformly spaced light emitting diodes (LEDS) that can be individually energized to expose a photoreceptor or other information receiving medium and, more particularly, to means for supporting the light emitting diode array chips and other electronic components incorporated in such a printhead.

2. Description of the Prior Art

A printhead of the type to which the present invention is directed comprises a row of uniformly spaced light emitting diodes (LEDS) that can be individually energized to expose a photoreceptor or other information receiving medium to reproduce an image pattern. A typical LED array of this type for standard DINA4 paper dimensions would be about 216 mm long. The individual light sources are very small and very closely spaced, e.g. 160 per cm, which makes it impossible at the present state of the art to provide a full length array in one piece. Accordingly, the array comprises a number of individual LED array chips, each being typically less than 10 millimeters long, which are mounted in endwise relation to one another to provide the entire array.

To control the energization of the individual LED sites, each LED chip is connected along each edge to one of the corresponding control chips and each control chip, in turn, is connected along its other edge to circuit board means which provide for electrical connections between the printhead and other electrical components of the machine in which it is employed.

In most previously known printheads of this type, the LED array chips, the driver chips and the circuit board means are all supported to a wide flat face of a support bar of generally rectangular cross section, which is provided on its opposite face with a finned metal heat sink or the like to dissipate heat from the bar. The bar itself is typically made of metal, e.g. stainless steel, having approximately the same coefficient of expansion as that of the support material of the LED array chips, which is usually galium arsenide. Because the light emitting sites of the LED chips must be very accurately co-planar so that the emitted light can be precisely focused by a so-called Selfoc lens, which has a very short focal length, the surface of the support bar supporting the LED array chips must be of correspondingly precise flatness and must maintain that flatness notwithstanding the heat transmitted to the bar from the chips during operation of the printhead.

The typical use of a wide support bar having the chips mounted along its wide face presents two significant problems in achieving and maintaining the required co-planar location of the light emitting sites. First, because the required thermal expansion characteristics of the bar, the stainless steel or other metal alloy that must be used is typically difficult to machine to the required tolerances. Secondly, because the chips, particularly the LED array chips, transmit considerable heat to the bar along the central region of its flat support face, the resulting thermal gradients through the bar tend to bow it both along its longitudinal axis and also traversely to that axis. Accordingly, the support surface is not simply bowed in one direction but tends to bulge, which makes it very difficult to predict and prevent such distortion by conventional cooling means.

U.S. Pat. No. 3,701,123, issued on Oct. 24, 1972 discloses an integrated circuit module comprising a row of individual LED chips mounted along the narrow edge of a support bar provided on one of its wide faces with a control chip and with wiring means connecting the control chip to the LED chips. A plurality of such bars are stacked together with their wide faces in confronting relation to provide a two-dimensional visual display. However, in the disclosed construction, no means are provided for dissipating heat from the support bar and, because the device is intended for use only as a visual display, there are no stringent requirements that the LED sites be co-planar.

U.S. Pat. No. 4,506,272 discloses a thermal printhead comprising a row of small heater elements located along a cylindrical bar which, in turn, is supported by a concave narrow edge of a support bar sandwiched between substrate members carrying control chips and other electrical elements for energizing the heater elements. No means are disclosed for dissipating heat from the thermal printhead and such a device inherently does not involve maintaining the heater elements in co-planar relationship to an extremely high degree of accuracy, because the paper being printed can be in contact with those elements and can conform slight distortions or inaccuracies.

SUMMARY OF THE INVENTION

In accordance with the present invention, an LED array printhead comprises an elongate support bar of generally rectangular cross section with a row of LED array chips mounted end-to-end along one of its long and relatively narrow edge faces. The support bar is sandwiched between heat sink or heat dissipating members that confront the wide faces of the bar and that support circuit board means by which the LED array chips are connected to circuitry of the machine in which the printhead is incorporated. Only the narrow face of the bar supporting the LED array chips need be machined to a high degree of accuracy and the narrow configuration of the chip support surface greatly simplifies the problem of minimizing thermal distortion of that surface.

Various means for practicing the invention and other novel features thereof will be apparent from the following description of an illustrative preferred embodiment thereof, reference being made to the accompanying drawings in which:

DESCRIPTION OF THE ILLUSTRATIVE PREFERRED EMBODIMENT

Figure 1:
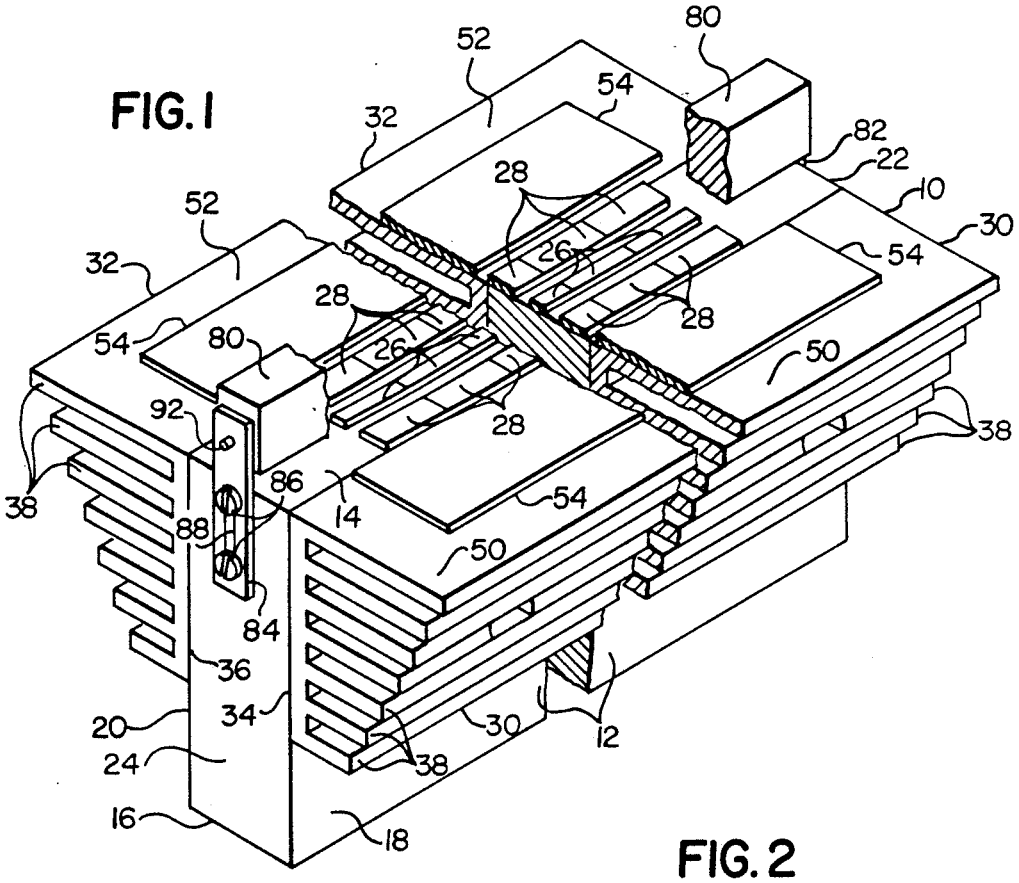
FIG. 1 is a fragmentary perspective view of an LED arrray printhead according to a preferred embodiment of the invention.

As is most clearly depicted in FIG. 1, the LED printhead 10 according to a preferred embodiment of the invention comprises an elongate support bar 12 of generally rectangular cross section, with relatively narrow elongate opposed faces 14 and 16 and relatively wide elongate opposed faces 18 and 20. Only face 14 is machined to a very high degree of flatness; the other faces, including end faces 22 and 24, being flat only to ordinary manufacturing tolerances.

As will be described later in greater detail, a plurality of LED array chips 26, each with a cental row of evenly spaced light emitting sites, are bonded in end-to-end relation along the center region of the narrow face 14 of bar 12, with each LED array chip located between two corresponding control chips 28 similarly bonded to that face of the bar.

Figure 2:
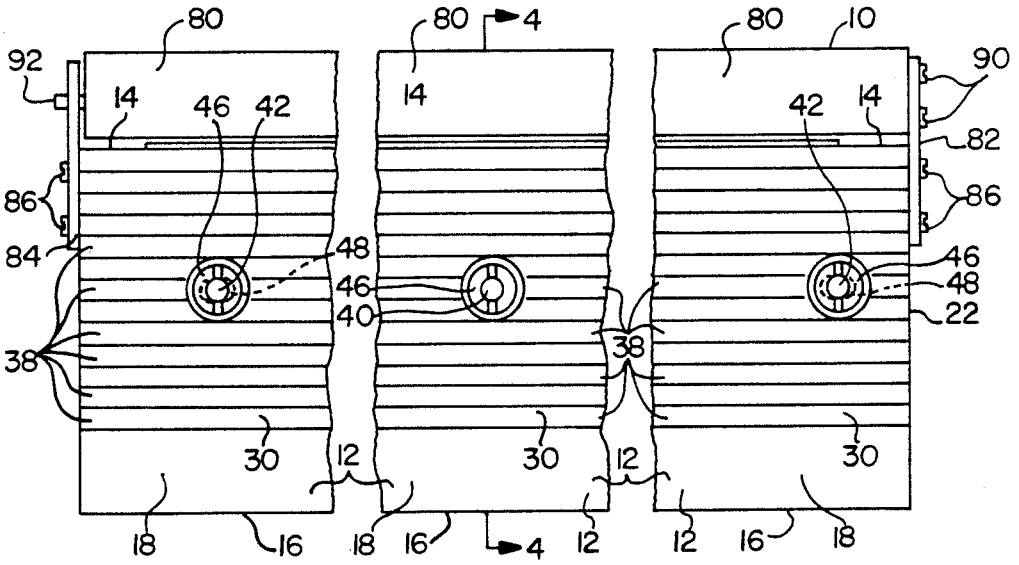
FIG. 2 is a fragmentary side elevational view of the printhead shown in FIG. 1.
Figure 4:
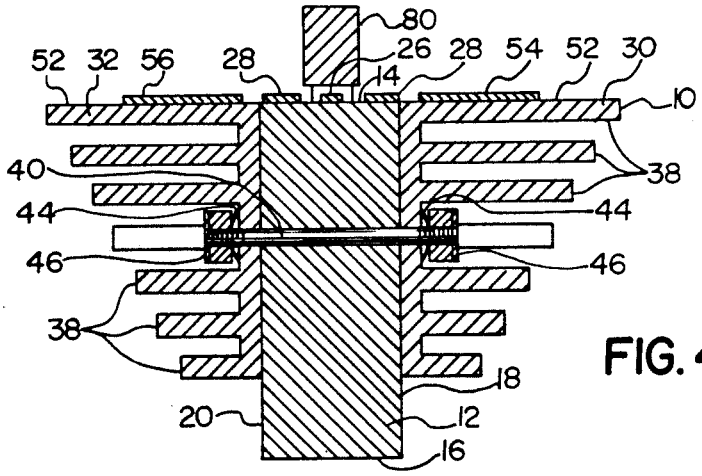
FIG. 4 is a cross sectional view taken along line 4—4 of FIG. 2.
Figure 5:
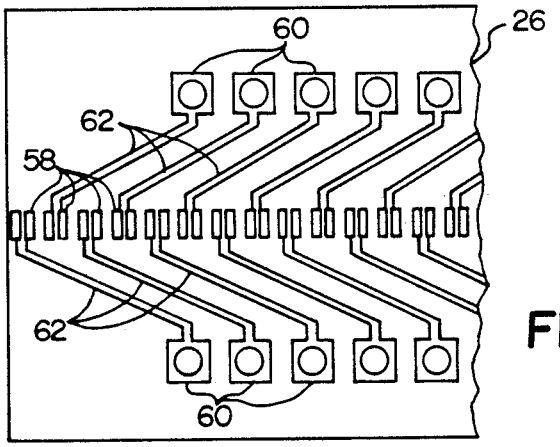
FIG. 5 is a fragmentary plan view of one of the LED array chips employed in the illustrative printhead.

Heat dissipating members 30 and 32 are mounted to the respective wide faces 18 and 20 of bar 12 so that the bar is sandwiched between the confronting faces 34 and 36 of those members. Members 30 and 32 are made of a metal such as aluminum, having a high coefficient of thermal conductivity, and are provided with cooling fins 38 to increase the surface area of those members. A silicon grease or other thermally conductive material is provided between the confronting faces of bar 12 and members 30 and 32 to improve heat transfer between those surfaces. Members 30 and 32 are held in place by a center screw 40 and by end screws 42, best shown in FIGS. 2 and 4. Spring washers 44 between the screw nuts 46 and the adjacent surfaces 48 of the heat dissipating members hold the latter against bar 12. The center screw 40 fits closely in corresponding holes through bar 12 and members 30 and 32. The end screws likewise fit closely in corresponding holes in bar 12, but the holes through members 30 and 32 that accommodate those screws are elongated slightly along the length of the printhead, as shown in broken lines at numeral 48 in FIG. 2, so that relative sliding movement can occur between the confronting surfaces of the end portions of the bar and the heat dissipating members, to accommodate different rates of thermal expansion.

Support faces 50 and 52 of the respective members 30 and 32 are substantially co-planar with face 14 of support bar 12 and carry respective circuit boards 54 and 56, which are held in place by a relatively elastic cement material or by clip or screw means similar to those used to hold member 30 and 32 to bar 12, thereby accommodating a small amount of relative sliding movement attributable to the different degrees of thermal expansion between the circuit board material and the heat dissipating member material. Unlike the LED arrays, which generate a relatively large amount of heat and which are inherently quite fragile, the control chips and the circuit boards generate relatively little heat and are relatively rugged, which makes it less important to closely match the thermal expansion characteristics of those components with those of the surfaces to which they are mounted.

If it is desired to reduce the relative movement between members 30 and 32 and the confronting surfaces of the support bar 12 or the circuit boards 30 and 32, particularly in the case of relatively long printheads, several heat dissipating members can be used along each face of the support bar, in closely spaced end-to-end relation to each other, each of such sections being mounted to the support bar by the same three screw arrangement previously described or by other equivalent means.

Figure 3:
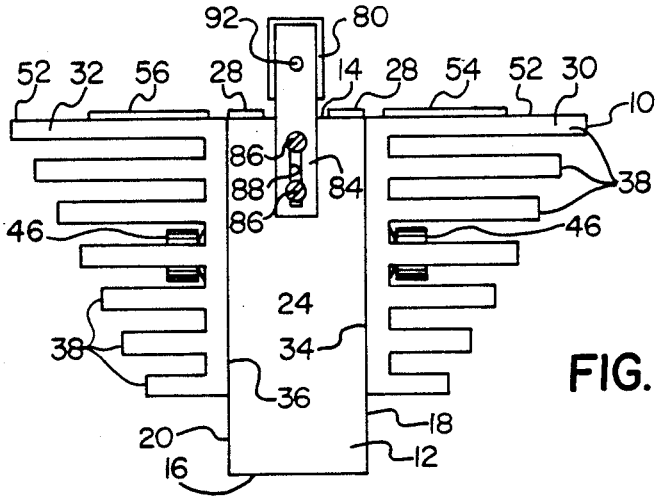
FIG. 3 is an end elevational view of the printhead shown in FIGS. 1 and 2.
Figure 6:
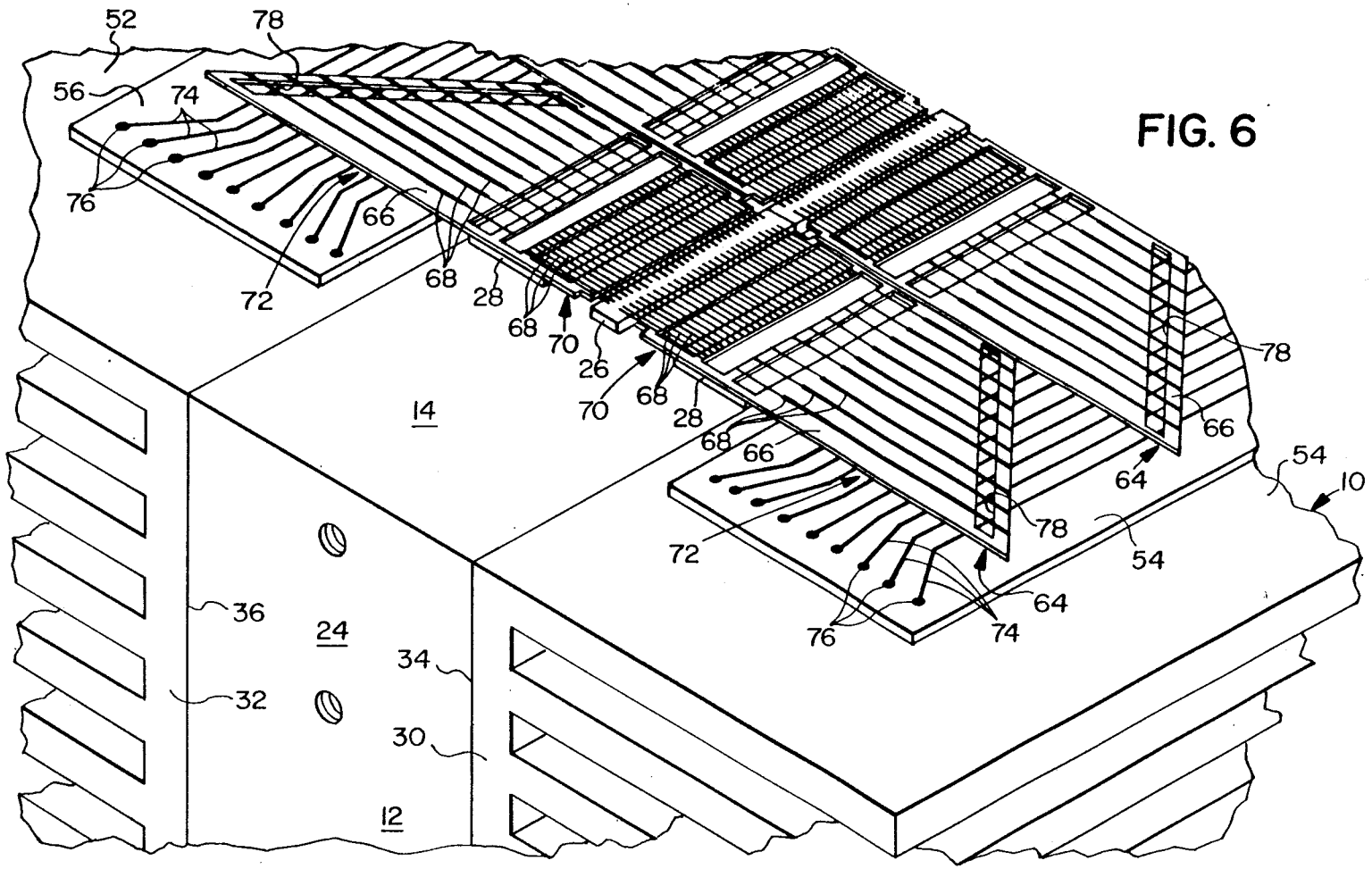
FIG. 6 is a fragmentary perspective view corresponding to an enlargement of a portion of FIG. 1 showing additional details of the electronic components of the printhead.

FIG. 3 shows a greatly enlarged portion of one of the LED array chips 26 and illustrates the individual light emitting sites 58 located along the center of the chip and connected to corresponding bonding pads 60 by connector bars 62. As shown in FIG. 6, each LED array chip 26 and its corresponding control chips comprise an assembly module 64 in which the chips are previously connected to each other by a tape automated bonding (TAB) process, which employs a web of plastic material 66 provided with conductor wires 68. Internal module regions 70 have a large number of closely spaced wires that connect the array chip 26 to the corresponding control chips 28. External module regions 72 comprise fewer and more widely spaced wires that connect the respective control chips to corresponding conductor strips 74 of the respective circuit boards 54 and 56, which, in turn, include bonding pads 76 by which the printhead is connected to a power source and to control electronics external to the printhead itself. Each assembly model is mounted to the support bar by adhesive material on the lower faces of the chips and the connecting wires of the external module portion are bonded, within openings 78 in the plastic web material, to the conductor strips of the circuit boards 54 and 56, which were previously attached to the respective members 30 and 32. Further details of such a modular construction are disclosed in commonly assigned co-pending U.S. patent applications Ser. Nos. 228,641 and 238,645, filed respectively on Aug. 5, 1988 and Aug. 30, 1988. It should be understood, however, that other means can be employed for mounting the chips to the support bar and for electrically connecting the chips to each other and to the circuit boards. For example, rather than being bonded directly to the support bar, each LED array chip can be bonded to a support plate or pallet, which, in turn is bonded to the support bar. Similarly, rather than using the illustrated module construction employing TAB techniques, the chips and the circuit boards can be electrically connected by conventional wire bonding means.

To image the light from the light emitting sites onto a photoconductor or other photosensitive surface, a so-called Selfoc lens bar 80 is supported by its ends closely adjacent to the LED array chips by means of adjustable support arms 82 and 84 attached to the opposite end faces 22 and 24 of support bar 12 by screws 86 extending through slots 88. To accommodate differences in thermal expansion between the lens bar 80 and the support bar 12, one end of the lens bar is attached to arm 82 by screws 90 but the other end of the lens bar is supported by a pin 92 slideably received in a closely fitting hole in arm 88.

It should be noted that those fins 38 of the illustrative heat dissipating members that are nearest chip support face 14 of bar 12 are wider than are those fins more remote from that surface, so that heat will be dissipated more rapidly from the hotter portion of the bar; thereby reducing the thermal gradient through the bar between faces 14 and 16, which, if completely eliminated, would prevent any bowing of the bar along the line defined by the light emitting sites of the LED array chips. The depicted cooling fin arrangement is illustrative only and various alternative types and configurations of fins or other heat dissipating means could be used to most effectively reduce temperature gradients through the bar. Furthermore, the support bar itself might be slotted or finned and liquid coolant passages might be provided in the bar or in the cooling members or in both. Similarly, various means could be employed to apply supplemental heat to the lower surface of the bar to minimize the undesirable temperature gradient. For example, thermistors might be employed to measure the temperature of corresponding regions of faces 14 and at 16 at a number of points along the support bar and to control corresponding supplemental heating resistors bonded to the lower bar face 16. Alternatively, strain gauges might be bonded to the bar to sense deflection and to control such auxiliary heating means to eliminate bowing.

Figure 7:
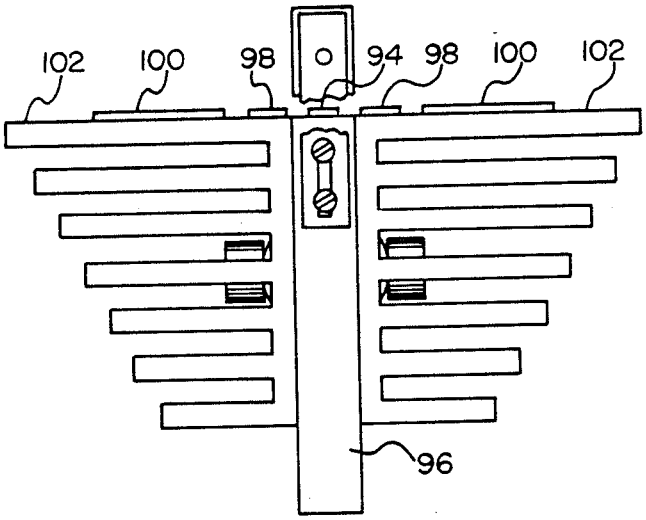
FIG. 7 corresponds generally to FIG. 3 but shows an alternate embodiment of the invention.

FIG. 7 illustrates an alternative embodiment of the invention similar to the embodiment previously described except for the fact that the LED array chips 94 are supported by the correspondingly narrower support bar 96; both the control chips 98 and the circuit boards 100 being supported by the heat dissipating members 102.

Preferably, the printhead is located with respect to the photosensitive surface in the machine in which it is installed by support means engageable with support bar face 14, so that thermal expansion or contraction of the bar in the direction between its faces 14 and 16 does not influence the location of the light emitting sites relative to the photosensitive surface.

We claim:

1. In a LED array printhead of the type comprising a row of LED array chips located end-to-end to provide a row of uniformly spaced light emitting sites, the improvement comprising:

an elongate support bar of generally rectangular configuration having a pair of opposite relatively narrow elongate flat faces between a pair of opposite relatively wide elongate flat faces;

means mounting said row of LED array chips on said support bar in end-to-end relation along the center region of one of said relatively narrow faces of said support bar; and heat dissipating means in heat transferring relation to both of said relatively wide faces of said support bar for dissipating heat from those surfaces.

2. The invention defined by cliam 1 in which said heat dissipating means comprises two heat dissipating members having flat heat transfer surfaces in confronting heat transferring relation to respective ones of said wide surface of said bar, said members being made of a material having a higher coefficient of thermal conductivity than that of said bar and including cooling means for increasing the surface area of portions of said members beyond said bar.

3. The invention defined by claim 2 in which said cooling means comprises a plurality of fins.

4. The invention defined by claim 1 including means for maintaining the confronting surfaces of said bar in heat transferring engagement with each other while allowing relative sliding movement between portions of those surfaces to accommodate differences in thermal expansion between said heat dissipating members and said bar.

5.In a LED array printhead of the type comprising a row of LED array chips located end-to-end to provide a row of uniformly spaced light emitting sites, the improvement comprising:

an elongate support bar of generally rectangular configuration having a pair of opposite relatively narrow elongate flat faces between a pair of opposite relatively wide elongate flat faces;

means mounting said row of LED array chips on said support bar in end-to-end relation along the center region of one of said relatively narrow faces of said support bar; and heat dissipating means in heat transferring relation to both of said relatively wide faces of said support bar for dissipating heat from those surfaces; said heat dissipating means defining flat support surfaces at opposite sides of said narrow face of said bar and in generally co-planar relation thereto for supporting electronic components of said printhead other than said light emitting array chips.

6. The invention defined by claim 5 including control chips supported on said narrow face of said bar at opposite sides of each of said LED array chips and means electrically connecting each of said LED array chips with the corresponding two control chips.

7. The invention defined by claim 5 including circuit board means carried by each of said flat support surfaces and electrically connected to the adjacent ones of said control chips.

* * * * *